US005489784A

United States Patent [19]

Koiranen et al.

[11] Patent Number: 5,489,784

[45] Date of Patent: Feb. 6, 1996

[54] METHOD AND DEVICE FOR MONITORING AN EDGE OF A MOVING WEB WITH A BAR OF RADIATION

[75] Inventors: Jukka Koiranen, Jyväskylä; Kari Pellinen, Säynätsalo; Olli Sarkkinen, Jyväskylä, all of Finland

[73] Assignee: Valmet Paper Machinery, Inc., Helsinki, Finland

[21] Appl. No.: 367,778

[22] Filed: Jan. 3, 1995 .

Related U.S. Application Data

[63] Continuation of Ser. No. 165,449, Dec. 10, 1993, abandoned.

[30] Foreign Application Priority Data

Dec. 16, 1992 [FI] Finland ..... 925728

[51] Int. Cl.[6] ..... G01N 21/86

[52] U.S. Cl. ..... 250/548; 250/559.36; 226/20

[58] Field of Search ..... 250/548, 557, 250/560, 561, 559.36, 559.3, 559.24; 356/385, 386; 226/20, 15, 16

[56] References Cited

U.S. PATENT DOCUMENTS

| | | | |
|---|---|---|---|
| Re. 32,967 | 6/1989 | St. John et al. | 250/557 |
| 3,311,749 | 3/1967 | Briggs | 250/219 |
| 3,998,616 | 12/1976 | Farabaugh | 65/29 |
| 4,146,797 | 3/1979 | Nakagawa | 250/548 |
| 4,147,977 | 4/1979 | Dimmick | 324/121 R |
| 4,484,478 | 11/1984 | Harkonen | 73/861.08 |
| 4,559,451 | 12/1985 | Curl | 250/560 |
| 4,641,070 | 2/1987 | Pfizenmaier et al. | 250/561 |
| 4,891,528 | 1/1990 | Kuecker et al. | 250/548 |
| 4,924,106 | 5/1980 | Tolmie, Jr. | 250/561 |
| 5,021,674 | 6/1991 | Brunner | 250/561 |
| 5,166,532 | 11/1992 | Brunner et al. | 250/548 |

FOREIGN PATENT DOCUMENTS

| | | |
|---|---|---|
| 0517928 | 12/1992 | European Pat. Off. . |
| 910571 | 2/1991 | Finland . |
| 3336726 | 5/1985 | Germany . |
| 3423308 | 1/1986 | Germany . |
| 3612145 | 10/1987 | Germany . |
| 3729982 | 3/1989 | Germany . |
| 3900928 | 6/1990 | Germany . |
| 2000587 | 1/1979 | United Kingdom . |
| 8103708 | 12/1981 | WIPO . |
| 9212054 | 7/1992 | WIPO . |

*Primary Examiner*—Edward P. Westin
*Assistant Examiner*—Que T. Le
*Attorney, Agent, or Firm*—Steinberg, Raskin & Davidson

[57] ABSTRACT

Method and device for monitoring a moving web, such as a wire in a paper machine, a felt, or a material web, such as a board or paper web. A bar of radiation beams is directed at the face of the web to be monitored by a series of transmitters in a direction transverse to the direction of movement of the web. Radiation reflected from the web and the background is detected by a series of receivers. The measurement signals obtained in this way are passed to an electronic unit in which a quantity that characterizes the monitoring of the web is determined from the measurement signals. The approximate location of the edge, the edges, or of corresponding discontinuities of the web is detected "digitally" on the basis of the radiation beam of the radiation transmitter in whose area the greatest change takes place in the received radiation. The precise location of the edge or equivalent of the web to be monitored is determined analogously by comparing the amplitudes of the signals of the adjacent receivers placed closest to the last-mentioned radiation transmitter with one another.

20 Claims, 6 Drawing Sheets

METHOD AND DEVICE FOR MONITORING AN EDGE OF A MOVING WEB WITH A BAR OF RADIATION

This is a continuation of application Ser. No. 08/165,449 filed on Dec. 10, 1993, now abandoned.

BACKGROUND OF THE INVENTION

The present invention relates to a method for monitoring a moving web, such as a wire in a paper machine, a felt or a material web, such as a board or paper web, in which a radiation bar is directed at the face of the web to be monitored by a series of transmitters. The radiation bar is arranged transverse to the direction of movement of the web, and radiation reflected from the web and the background is detected by means of a series of receivers. Measurement signals obtained from the series of receivers is passed to an electronic unit and a quantity that characterizes the monitoring of the web is detected from the measurement signals.

The present invention also relates to a device for monitoring an edge or equivalent of the moving web, comprising a measurement head, which is arranged free of contact with the web and in proximity to the web to be monitored. The measurement head includes a series of radiation transmitters and a series of radiation receivers, which receive the radiation derived from the radiation transmitters and reflected from the web to be monitored and from the background. On the basis of the reflected radiation, it is possible to form a measurement signal or a series of measurement signals which represent the position of the edge or edges of the web and/or the distance between the edges and/or a point of discontinuity in the web.

In paper machines and other paper forming equipment, in which a continuous material web is manufactured and/or closed fabric loops are employed, it is necessary to identify the location and/or the presence of the edge of the material web or the fabric in various stages of the paper-making process. For this purpose, photoelectric means of identification are typically used. These prior art identification devices usually operate so that a source of light and a photocell are placed at opposite sides of the fabric or web to be monitored. A break of the web and/or a shifting of the edge of the web or fabric results in the photocell receiving the beam of light, transmitting an impulse further, which results in an alarm and possibly in other responsive action.

In the monitoring of an edge of a wire in a paper machine, it is known in the prior art to use three photocells placed side by side, wherein each of the cells operates by an "on/off" principle. The precision of this monitoring device and/or the width of the area of monitoring has/have, however, proved unsatisfactory in several applications.

Also, in the prior art, various identification devices are known which are based on reflection of light taking place from the material to be monitored and on changes occurring in the reflection. As an example of such devices, reference is made to U.S. Pat. No. 4,146,797, wherein an identification device for locating the edge of a material web is described. The device includes a source of light and a detector of light. The source of light in this device directs a spot of light at the lateral area of the web to be monitored. The position of the lateral area is monitored and the position of the edge of the web is measured on the basis of changes taking place in the intensity of the reflected light.

Prior art photoelectric identification devices do not operate adequately in all respects, but disturbances occurs in them, and they require constant supervision, frequent calibration and cleaning. Paper machines are also an operational environment that impose very high requirements because of high temperature, moisture, and impurities, which produce disturbance in the prior art photoelectric identification means. With the constantly increasing running speeds of paper machines in existence and as planned in the near future, these problems have increased further.

The increasing running speeds of paper machines are also influential in this connection whereby ever higher and more demanding requirements are imposed on the regulation systems that control the transverse positions of the fabrics in the paper machine. These requirements are applied in particular to the precision and rapidity of the measurement of the position of a fabric.

The operation of the prior art web-monitoring devices is also disturbed by the background light and by the changes in same, such as oscillations in fluorescent tubes arising from the mains frequency. In the environment of a paper machine, there is also a considerable amount of infra-red radiation. Since most photocells are sensitive to infra-red radiation, this causes disturbances in the photoelectric identification means.

With respect to prior art in the same field as the present invention, reference is made to U.S. Pat. No. 4,146,797 and to the assignee's Finnish Patent Application No. 910571 (corresponding to EP Appl. No. 91 850153.7 and U.S. Ser. No. 07/719,762, the specification of which is hereby incorporated by reference herein). In FI 910571, a method and a device are described for identifying a moving material web, wherein a beam of light is directed at the material web by means of a transmitter device. The beam of light causes a second beam of light to be reflected from the face of the material web to be identified. The second, reflected beam of light is converted by a receiver device into an electric signal. On the basis of the electrical signal, the presence, quality, condition, and/or position of the material web is/are identified. The intensity of the beam of light transmitted from the transmitter of light is regulated on the basis of the intensity of the reflected beam of light. The reference level(s) of the electric identification signal derived from the reflected beam of light is adapted in compliance with the environment of operation so as to optimize the identification and to minimize interference from the environment. The device also includes a microprocessor, to which an analog signal is passed through an A/D converter. The microprocessor controls the unit for regulation of the intensity of the light to be transmitted, which unit controls an adjustable voltage source from which a regulated operation voltage is supplied to the transmitter of light.

OBJECTS AND SUMMARY OF THE INVENTION

It is an object of the present invention to further the development of prior art methods and devices mentioned above.

It is another object of the present invention to provide a novel system for monitoring a fabric or a material web in particular for paper machines, which system is reliable in operation and substantially insensitive to disturbance as well as more versatile in its operation.

It is still another object of the present invention to provide a novel system for monitoring a fabric or a material web in particular for paper machines, which system is more accurate and quicker with regard to the detection of the position of the web.

It is a further object of the present invention to provide a new and improved method and a device in which it is possible to use two or even more measurement heads, which can be placed at the same edge of the web to be monitored and/or at the opposite edges. In the latter case, the method and the device of the invention can also be integrated to measure the width of the web. When the embodiment wherein two or more measurement heads placed at the same edge of the fabric or web are used, the monitoring system in accordance with the present invention can also be used for detecting the web speed and/or any edge defects in the web.

In view of achieving the objects stated above, and others, the method of the present invention is mainly characterized in that the approximate location of the edge, edges, or of equivalent points of discontinuity of the web to be monitored, is detected "digitally" on the basis of a radiation transmitter in the area of whose radiation beam the greatest change takes place in the received radiation. The precise location of the edge or equivalent of the web is determined analogously by comparing the amplitudes of the signals of the nearest receivers adjacent to the radiation transmitter with each other.

The device in accordance with the present invention includes a measurement head is provided in which radiation transmitters and radiation receivers are placed, in an alternating relationship with each other, in a row or in an equivalent formation. The principal direction of the row or formation is substantially transverse to the running direction of the web to be monitored. Other orientations are also possible. The radiation receiver placed between two successive sources of radiation is arranged to detect the radiation derived from both radiation transmitters and reflected from the web to be monitored and/or from the background. The device further includes an electronic unit having a control logic, which controls the measurement sequences of the device, as well as a signal transfer unit, which transfers the signals obtained from the various receivers successively to the electronic unit. In the electronic unit, a web-monitoring quantity can be formed by the application of an analog-digital principle of measurement.

In the present invention, the analog-digital principle of measurement is applied so that the approximate position of the edge of the web, or any other point of discontinuity, to be monitored in the direction transverse to the running direction of the web is determined by the digital principle. The precise position is determined analogically by comparing the signal levels of the two adjacent radiation receivers, between which the radiation transmitter is placed facing the edge of the web, to each other. In the analogical determination, a linear model is preferably applied.

In the present invention, pulsed light ($\lambda$ is about 620 nm) is preferably used as the measurement radiation, so that the measurement pulses are controlled alternatingly and successively to sweep over the different radiation transmitters. During the light pulses, the reading of the receiver placed between the transmitters is carried out at a precisely specified point of time. The series of measurement pulses are repeated at sufficiently short intervals so that the necessary detection resolution is obtained.

In the measurement system in accordance with the invention, a separate electronic unit is preferably used, in which the measurement results are computed and processed in any other way, and also the measurement sequences are controlled. In order to keep the capacity of the data transfer channel between the electronic unit and the measurement head reasonable, it is preferable to place a certain amount of control electronics and "intelligence" in the measurement head itself.

In a preferred embodiment of the invention, the row of radiation transmitters/receivers extends over an area wider than the area of measurement itself, so that, in the monitoring of the edge of the web, the first transmitter always directs its beam at the background when viewed from outside the web, and the last transmitter always directs its beam at the face of the web to be measured.

It should be emphasized that even though, above and in the following, "light" is spoken of, it is not necessarily visible light that is meant, but in some cases it is also possible to use an electromagnetic radiation placed outside the wavelengths of visible light, in particular infrared radiation, which has suitable properties of reflection from the object to be measured as well as little disturbance.

The scope of the present invention also includes applications in which an induction measurement based on an electromagnetic phenomenon is used. In this embodiment, the web to be identified is a web made of a conductive material or a band made of a conductive material, so that the principle of eddy current can be applied in the measurement.

In the following description, the term web will be used for the object to be monitored, which term refers to a moving material web in general, such as a paper or board web or any other material web manufactured in process industry, or fabrics that form a closed loop, such as a forming wire, drying wire, or a press felt in a paper machine.

Also, in the following description, the present invention will be described in detail with reference to some exemplifying embodiments of the invention illustrated in the figures in the accompanying drawings. However, the invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
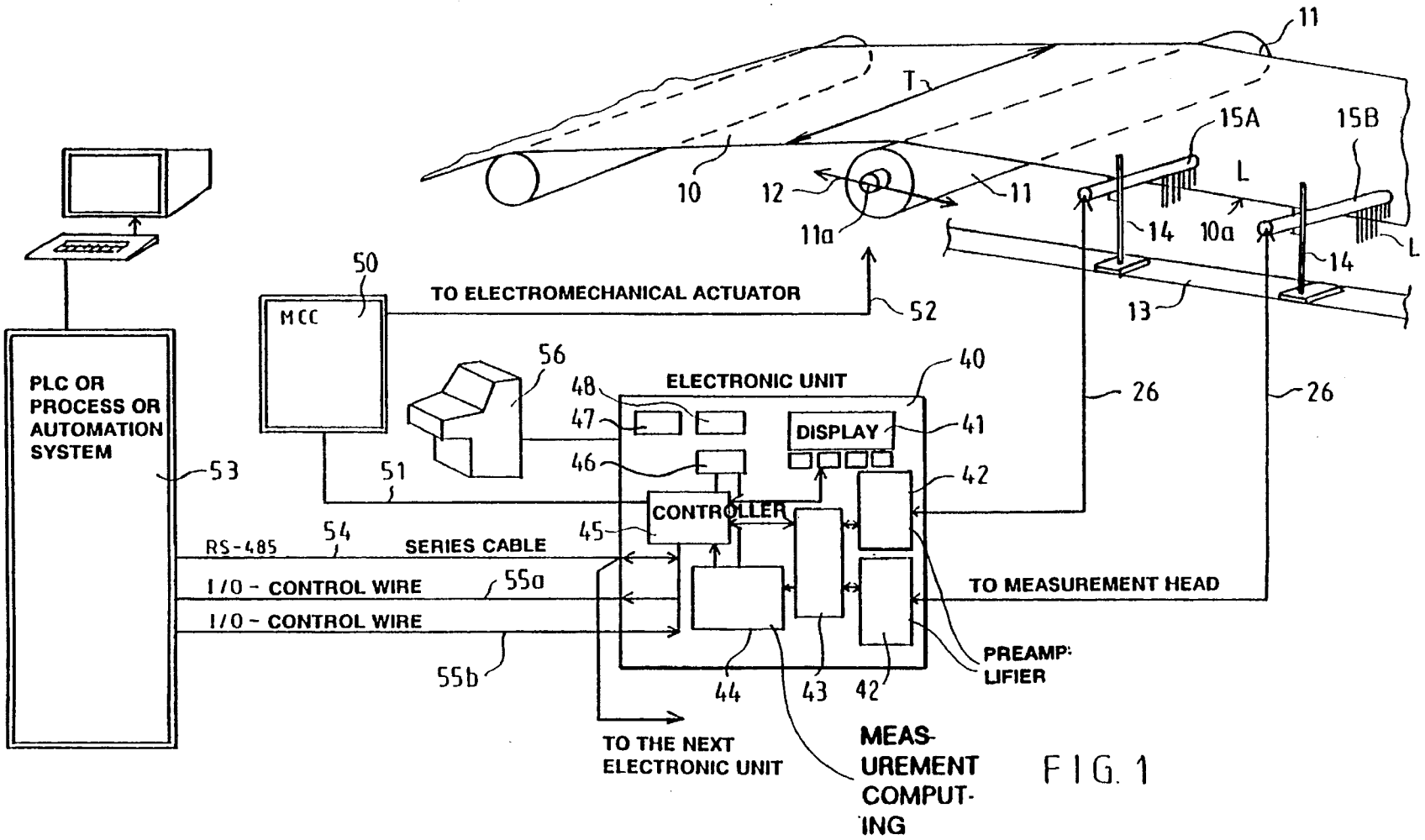
FIG. 1 is a schematic illustration of the web monitoring system in accordance with the present invention, partly as a block diagram.

FIG. 1 shows a block diagram of the monitoring system in accordance with the present invention and an exemplifying embodiment of the basic operating principles of the present invention. By means of the present system, the location of one edge 10*a* of a paper machine wire 10 in the transverse direction is monitored. The web to be monitored may also be other than a wire, for example, a felt or an edge or the edges of a paper or board web. The position of the edge 10*a* of the web 10 is regulated by means of an alignment roll 11. The position of one of the axle journals 11a of the roll 11 is adjusted by means of a mechanical actuator, which is represented schematically by arrow 12. In proximity to the edge 10*a* of the web 10, two measurement heads 15A and 15B are placed one after the other. The measurement heads are fixed preferably to vertical arms 14 so that their height positions relative to the surface of the web can be adjusted. Arms 14 are fixed at the tending side of the paper machine on support of a frame beam 13.

Referring to FIG. 1, the monitoring system in accordance with the present invention includes an electronic unit 40, which is connected to measurement heads 15A and 15B by electric cables 26. The electronic unit 40 includes a controller 45, a microprocessor 46, a display monitor 41, a RAM (random access memory unit) 48, and an EPROM unit 47, all of which are connected to each other. The measurement signals are passed from the measurement heads 15A and 15B through the cables 26 to preamplifiers 42, which are connected to a control logic unit 43. The control logic unit 43 is connected to the controller 45 and to the measurement computing unit 44. The units 43 and 45 control the measurement sequences of the measurement heads 15*a* and 15*b*, which are repeated at specific intervals in, e.g., predetermined sequences.

Further, the measurement system includes a mechanical control unit 50 connected to the controller 45 by means of a cable 51. Through a connection 52, the unit 50 passes a control signal to the actuator (12) that displaces one of the axle journals of the alignment roll 11. The electronic unit 40 is connected, by means of a series cable 54 (e.g., RS-485) and/or by means of I/O-control wires 55*a* and 55*b*, to a PLC or equivalent process or automation system 53, which controls the operation of the entire process, such as a paper machine.

The electronic unit 40 is connected to a control desk 56, by means of which the web monitoring system and the transverse position of the web 10 can be manually controlled. Manual control can also be accomplished by an automation system 55 by the intermediate of the series cable 54.

The system shown in FIG. 1 operates in principle as follows. The measurement heads 15A and 15B direct a set of light beams L, e.g., radiation beams forming a radiation bar, in an area in proximity to the edge 10*a* of the web 10. A part of the set of light beams L is reflected from the web 10 and another part is reflected from the background. From the measurement heads 15A, 15B, the measurement signals are transferred through cables 26 to the electronic unit 40 which processes the measurement signals in a manner which will be explained in more detail later. The control unit 45 and the control logic 43 in the electronic unit 40 give control signals through cables 26 to control the operating sequences of the measurement heads 15A and 15B. The sequences are repeated at specific time intervals when desired. Thus, the data transfer in the cables 26 takes place in two directions, i.e., bi-directional. A certain amount of electronics and "intelligence" can also be arranged in the measurement heads 15A and 15B themselves.

The electronic unit 40 gives a control signal to the unit 50 through cable 51. Unit 50 gives a regulation signal to the electro-mechanical actuator (12) of the alignment roll 11 so that the edge 10*a* of the web 10 is guided and kept in the position determined by a set value by means of the feedback-connected regulation system. Moreover, the electronic unit 40 is connected to the automation system 53 proper of the paper machine or equivalent so that the electronic unit 40 can receive control signals through cables 54, 55*a* and 55*b* and, in a corresponding manner, it can give various signals to the system 53.

Figures 2, 3:
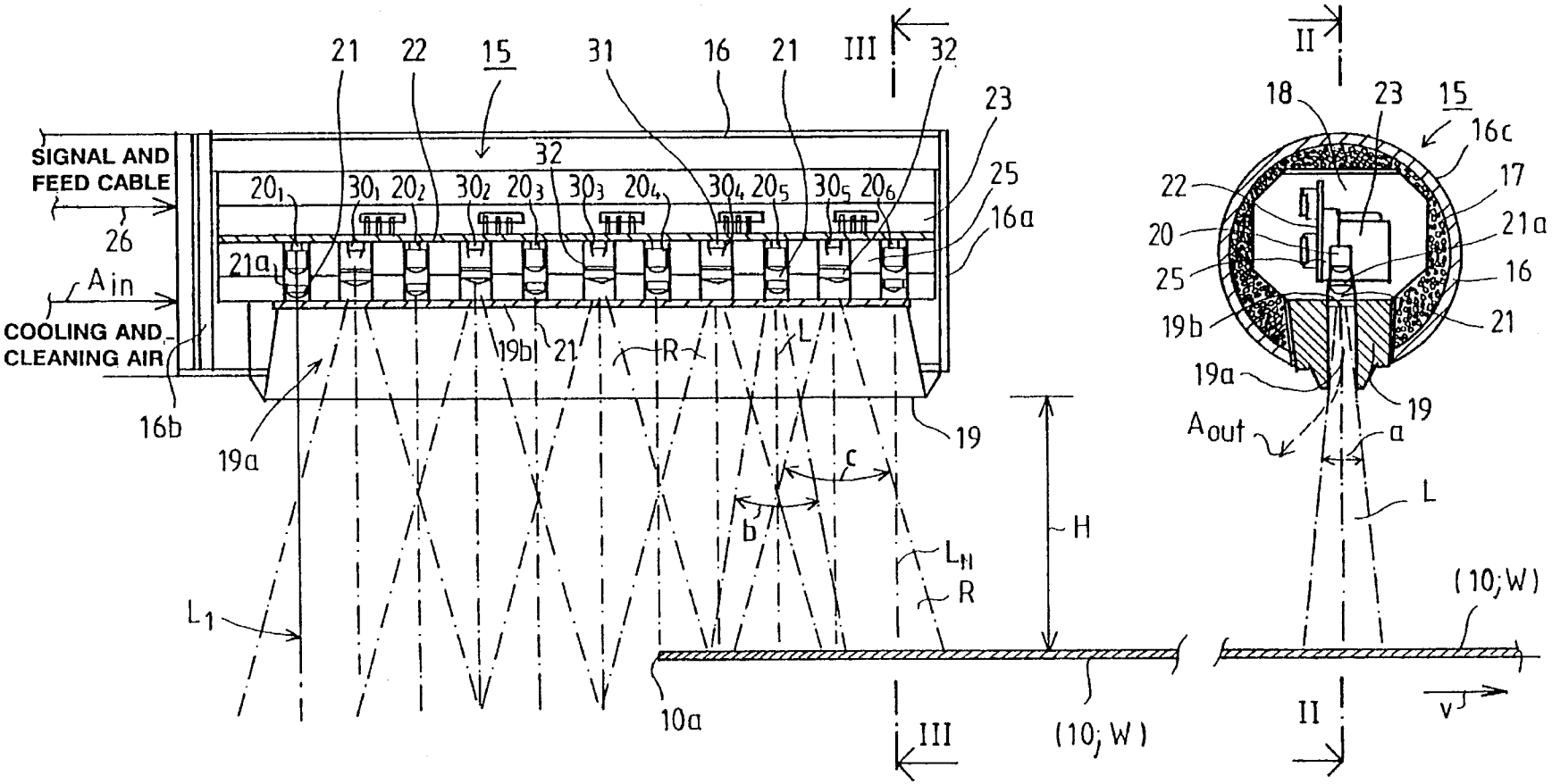
FIG. 2 is a central axial sectional view of a measurement head in accordance with the present invention taken along the line II—II denoted in FIG. 3.
FIG. 3 is a vertical sectional view taken along the line III—III in FIG. 2.

In the following, with reference to FIGS. 2 and 3, a preferred exemplifying embodiment of the construction and operation of the measurement head 15 in accordance with the present invention will be described. The measurement head 15 comprises a cylindrical box part 16, having a closed end wall 16*a* at one end and, at the opposite end, a second end wall 16*b* having connections for the cable 26 and for the supply $A_{in}$ of cooling and/or cleaning air.

In the measurement head 15, inside the box 16, there are six transmitter LEDs $\mathbf{20}_1, \ldots, \mathbf{20}_6$ (Light emitting diodes) and five receiver diodes $\mathbf{30}_1, \ldots, \mathbf{30}_5$ or the measurement light, e.g., photodiodes. The transmitters 20 and the receivers 30 are arranged, preferably evenly spaced, in a straight line so that one of the transmitters 20 is arranged on both sides of each of the receivers 30. For example, components 20 and 30 are placed at a uniform distance of about 20 mm from each other. Each receiver 30 sees (view sector R) one half of the areas illuminated by the light beams L of both of the transmitters 20 placed at its sides. To form the radiation bar, the transmitters 20 are switched on by the electronic unit 40 alternatingly in a given, preselected sequence so that there are always two adjacent transmitters 20 on, with the exception of the transmission of a reference signal. Simultaneously, the reading of the receiver 30 situated between two adjacent transmitters 20 takes place. The duration of the radiation pulses of the transmitters 20 is, e.g., from about 10 μs to about 100 μs, and preferably about 50 μs. The receiver 30 is always read at a certain moment during the radiation pulses of the transmitters.

The two extreme transmitters $\mathbf{20}_1$ and $\mathbf{20}_6$ in the measurement head are reference transmitters, whose beams L always arrive at the corresponding receivers, the inner one exclusively on the face of the object 10,W to be monitored, and the outer one exclusively outside the object 10,W. However, the transmitters $\mathbf{20}_1$ and $\mathbf{20}_6$ are also used for formation of the measurement signal with the receivers $\mathbf{30}_1$ and $\mathbf{30}_5$. It is assumed that the edge 10*a* of the object 10,W always remains between the beams L of the extreme transmitters $\mathbf{20}_1$ and $\mathbf{20}_6$. If needed, additional transmitters and receivers can be added to ensure that the edge of the web always remains within the beams of the transmitters.

The measurement beams L proper, which are used to determine the exact location of the edge of the web, are the beams with the subscripts 2, 3, 4 and 5. Each beam L illuminates an area of, for example, from about 40 mm to about 50 mm. The width of the measurement area proper is thus generally about from 100 mm to about 200 mm, preferably about 160 mm. The beams L partially overlap each other, and thereby guarantee that no shadow areas remain between the beams L.

The beams L of the transmitters 20 are formed out of the light of the LED by means of a lens 21 and a shade 21*a*. It is desired that the brightness level of the beams L is made as uniform as possible over the entire area of reflection. For this purpose, in the electronic unit 40, correction factors are computed for each transmitter so that the computed brightness of the beams L should be equal. In front of the receivers 30, there are no lenses, but there are filters 32 which eliminate substantially all of the interference produced by the outside lighting.

The transmitters 20 and the receivers 30 are attached to an optical frame 25 by means of various holders, which have a small allowance for adjustment for precise alignment of the beams L. The control electronics of the transmitters 20 and of the receivers 30 are arranged on a card 22 attached directly to a frame 23 by means of spacer bushings. The frame 23 and the electronics card 22 are protected by a double box 16,16C or by one box 16 and insulation material 17. Between the inner box 16C and the outer box 16, there is thermal insulation 17 to reduce the heat transferred from outside, i.e., from the environment.

Cooling of the measurement head 15 takes place by blowing air $A_{in}$;$A_{out}$. Air $A_{out}$ is removed through a nozzle 19 that defines an elongate light opening 19*a* which extends a distance to provide for the passage of radiation therethough from the transmitters and to the receivers. The function of the exhaust air flow $A_{out}$ is to prevent access of contamination particles into, and accumulation of contamination particles in, the interior of the nozzle 19 and onto the face of the glass 19*b* that protects the light opening 19*a*. The cooling air ($A_{in}$) is passed from the inner box 16*c* into the equalizing chamber of the nozzle through the holes closed by covering gates. The function of the gates is to close the holes if the air blowing is stopped or if washing water attempts to flow in through the holes. The function of the equalizing chamber of the nozzle 19 is to equalize the flow at different points in the nozzle. The nozzle 19 is made of a material having a low thermal conductivity in order to prevent condensing of water. The outer box 16 is a smooth acid-proof tube which operates as a support frame proper and as a mechanical shield as well as a fastening arm for the measurement head 15.

The width a of the sector of the beams of light L in the direction of running M of the object 10,W is generally in a range from about 10 mm to about 30 mm, preferably about 20 mm, and the corresponding width of the sector of the beam of light L in the perpendicular direction (b) is from about 35 mm to about 45 mm, preferably about 40 mm. The angular width c of the sector of view of the receivers 30 is generally in a range from about 70 mm to about 90 mm, preferably about 80 mm. The distance H of the measurement head from the object 10,W is typically in a range from about 150 mm to about 250 mm and, if necessary, it can be arranged to be adjustable by varying the position of the measurement head 15 on the support arm 14.

As stated above, the number of transmitters 20 is preferably one higher than the number of receivers 30 (N=M−1). The number N of the transmitters 20 is generally in a range from about 4 to about 10, preferably N is between 5 and 7. The number N of the transmitters 20 depends on the width of the necessary area of measurement, and in some special applications it is possible to use even several dozens of transmitters, for example, in the embodiment wherein the entire width of the web is measured from one end to the opposite end. In this situation, the measurement head may extend across a major part of the width of the web to be measured.

The operation of the measurement system in accordance with the present invention is based on the circumstance that the light emitted by the transmitters 20 is reflected in different ways from the object 10,W and from the background. The light transmitters 20 are switched on preferably so that a "sweeping" illumination is produced, i.e., from one transmitter at an extreme end to another transmitter at an opposite extreme end. When the light meets the object 10,W, it is reflected more intensively than when it arrives outside the edge 10*a* of the object 10,W, and from reading the signals obtained from the different receivers 30, it is possible to notice a clear change which indicates the approximate location of the edge 10*a*. The amount of light reflected from the background is usually lower than that reflected from the object 10,W because the distance to and from the background is considerably larger. In the present invention, the approximate location of the edge 10*a* of the object 10,W is determined from the transmitter beam $L_n$ in whose area the greatest change takes place. The exact location can be determined by comparing the values of the signals of the receivers $\mathbf{30}_{n-1}$ and $\mathbf{30}_n$ adjacent to the transmitter beam $L_n$ to each other.

In the present invention, the precise location of the edge 10*a* can be determined advantageously by using a linear model whose starting point is the difference between the values of the signals of the last-mentioned receivers $\mathbf{30}_{n-1}$ and $\mathbf{30}_n$ and the mathematical sign (±) of the difference. Thus, in the invention, the digital and the analogical principles of measurement have been combined so that the approximate position of the edge 10*a* is determined digitally, and the precise position is determined by the analogical principle.

In this manner, it is possible to carry out a particularly precise measurement free of interference, which measurement system is also suitable for measuring the width of the web 10,W and, in a special case, also for measuring the web speed, for example, by making use of a correlation technique.

The basic comparison and calibration take place in comparison with the signals obtained from the areas of the reference transmitters $\mathbf{20}_1$ and $\mathbf{20}_6$. The reference transmitters $\mathbf{20}_1$ and $\mathbf{20}_6$ are arranged at both ends of the light bar, in which case the beam of one of them always meets the face of the object 10,W whereas the beam of the other one arrives outside the object.

Figure 4:
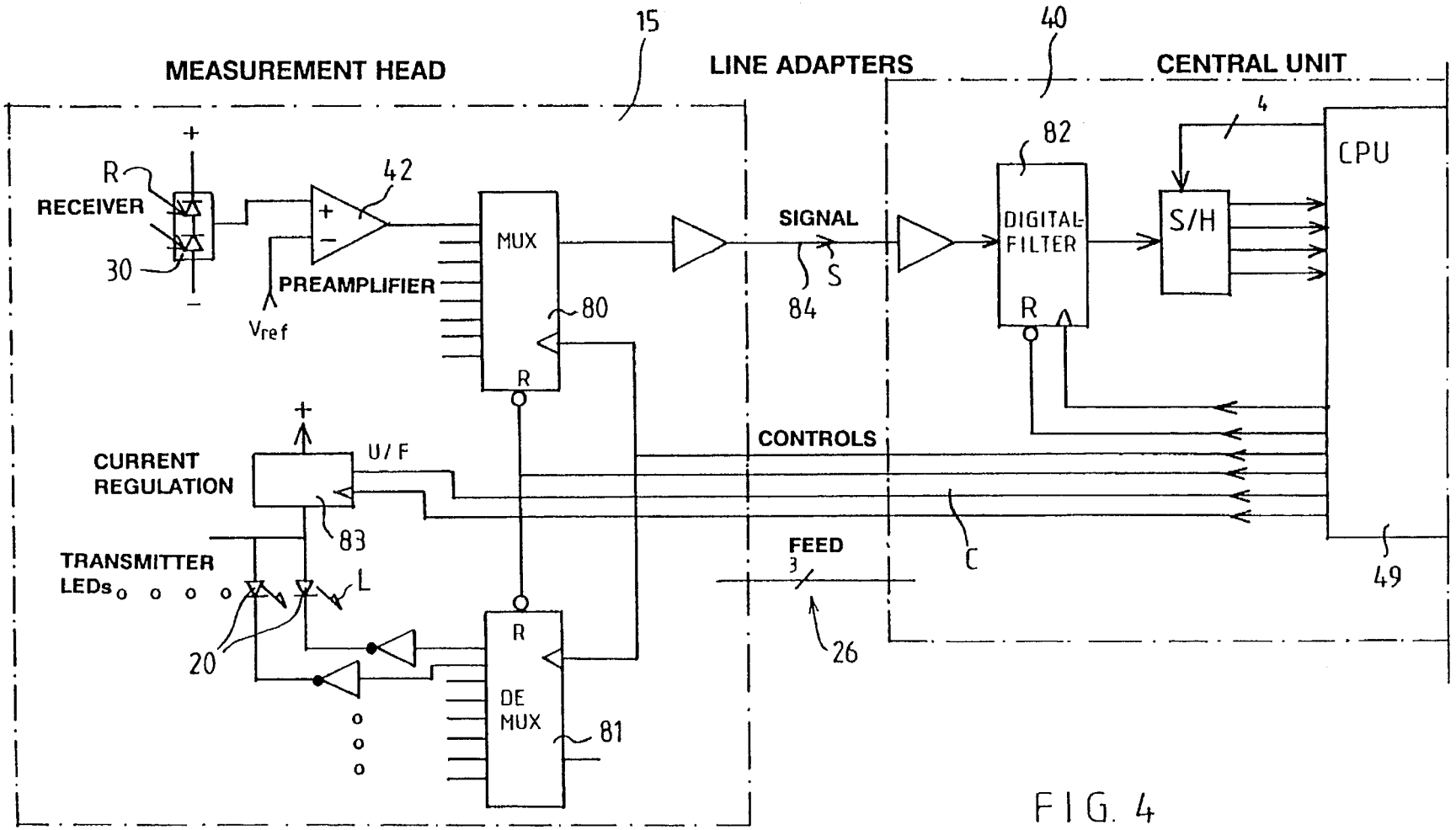
FIG. 4 illustrates the electric connections of the measurement-head unit and the central unit and the mutual joining of these units.

Referring to FIG. 4, the electrical wirings and the mating or joining together of the measurement head 15 and the central unit 40 will be described. The microprocessor 49 of the electronic central unit 40 transmits a control signal to multiplexing and demultiplexing circuits 80,81 of the electronic system of the measurement head 15 along the control signal cable c. After the control signal has been given, the transmitter LED $\mathbf{20}_1$ transmits a light pulse, and the receiver $\mathbf{30}_1$ measures the reflected light, transfers the signal through the preamplifier 42 to the MUX circuit 80 and from there through a line adapter 57*a* to the signal cable. The signal is further passed to the electronic unit 40 in which it is converted to digital form, filtered by means of a digital filter 82, and then passed further to the μP 49 (central processing unit or CPU) for computing. In this manner, the first reference level is obtained. Next, the electronic unit 40 switches LEDs $20_1$ and $20_2$ into a transmitting mode and, since the receiver $30_1$ operates synchronously, the unit 40 forms the first measurement signal from the signal of the receiver $30_1$. These steps are repeated until the second reference transmitter $20_6$ is reached, the control of which is arranged in the same way as that of the first reference transmitter $20_1$ . Moreover, as the last one, a sample is taken from an NTC detector (not shown), and on the basis of its signal data is formed concerning the temperature of the measurement head 15. The voltage supply for the measurement head is passed through the wires 26 from the electronic unit 40. The brightness of the transmitter LEDs is regulated on the basis of the reference signal by means of a current-regulation unit 83 so that any contaminations on the faces of the receivers 30 do not produce distortion of the signal.

Figure 5:
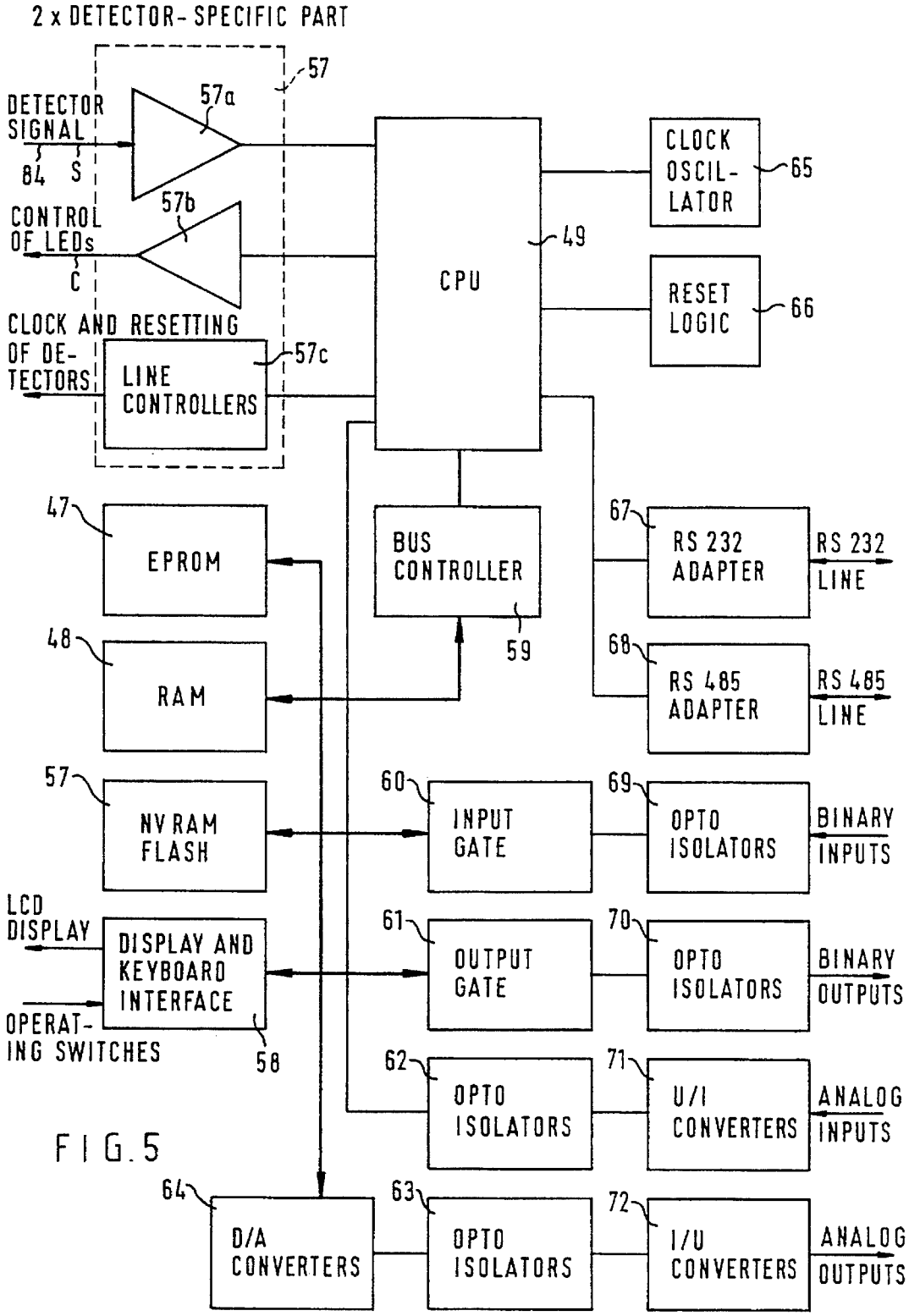
FIG. 5 shows the electronic unit of the monitoring system in accordance with the present invention as a block diagram more detailed than that shown in FIG. 1.

FIG. 5 shows a more detailed construction and the substantial operating components of the electronic unit 40 as a block diagram.

The environment of the processor 49 includes a clock oscillator 65, a RESET logic 66, a bus controller 59, and RS adapters 67 and 68 as integral parts. The clock oscillator 65 times the CPU 49 and, at the same time, it times the frequency of the samples being taken from the detectors. The RESET logic 66 supervises the operation of the CPU 49. The CPU 49 transmits a command to a line controller 57*c* to control the measurement operations of the measurement head 15. The line controller 57*c* transmits a clock pulse and a RESET pulse to the measurement head, by means of which pulses the transmitter LEDs 20 and the receiver diodes 30 are timed accordingly. The measured detector signal S is passed along a wire 84 to the line adapter and to the amplifier 57*a*, and then passed further to the CPU 49, in which the data are received and the output is transferred further to the RAM memory 48. From RAM memory 48, the signal is brought back for computation to the CPU 49.

In the NVRAM 57, the case-specific tuning parameters are stored, and in the EPROM 47, the program proper is placed, from which the CPU 49 seeks the necessary parameters and programs. An LCD display and operating switches are connected to the bus controller 59 of the processor bus through the user interface 58. The I/O's (Input/Output) are brought to isolators 69 and 70 from which they are passed through the gates 60 and 61 to the processor 49. The analog I/O's are passed through the I/U converters 71 and isolators 62 to the CPU 49, and through the D/A converters 64, isolators 63, and U/I converters from the CPU 49.

If the computation results in the measurement head 15 being slightly contaminated, the CPU 49 controls the control signal C for the LEDs 20 to a higher level by means of the amplifier 57*b*. In this manner, the brightness of the light of the LEDs 20 is increased. In the electronic system 40, there are detector specific components 57 for two measurement heads.

Figure 6:
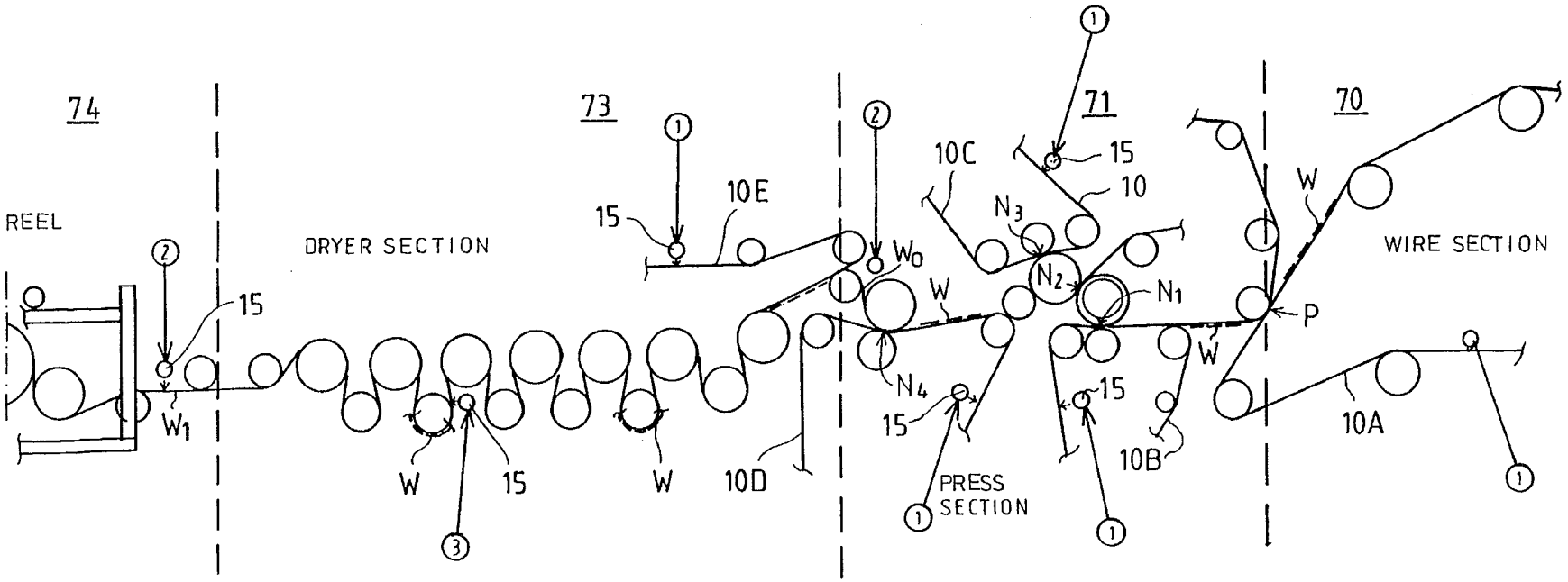
FIG. 6 illustrates different positions and location of measurement heads in accordance with the present invention in a paper machine.

FIG. 6 is a schematic illustration of a paper machine illustrating preferred locations of measurement heads 15 in accordance with the present invention. The paper machine, which is shown highly schematically, comprises a wire section 70, a press section 71, a dryer section 73, and a reel 74. The paper web W is transferred from the forming wire 10A at pick-up point P onto the press felt which carries it through press nips $N_1$ and $N_2$. The web W is then transferred into a third press nip $N_3$ and further onto a lower felt 10D of a fourth separate nip $N_4$. From the upper roll of the fourth nip $N_4$, the web W is transferred as a free draw $W_0$ onto a drying wire 10E and further through the dryer section 73. Hereupon, the web W is transferred as a free draw $W_1$ to the reel 74.

FIG. 6 shows measurement heads 15 in accordance with the present invention in position 1 to monitor the edge of the forming wire 10A, of the press felt 10B, 10C, and 10D as well as of the drying wire 10E. Further, a measurement head 15 in accordance with the invention is shown in position 2 to monitor the presence of the web W on the free draw $W_0$ and $W_1$, i.e., to detect a break and/or the location of the edge of the web W and/or the width T of the web. In position 3 in the dryer section 73, the measurement head 15 is shown as monitoring the presence of the web W running on support of the drying wire 10E and/or the location of the edge of the web and/or the width of the web.

Figure 7:
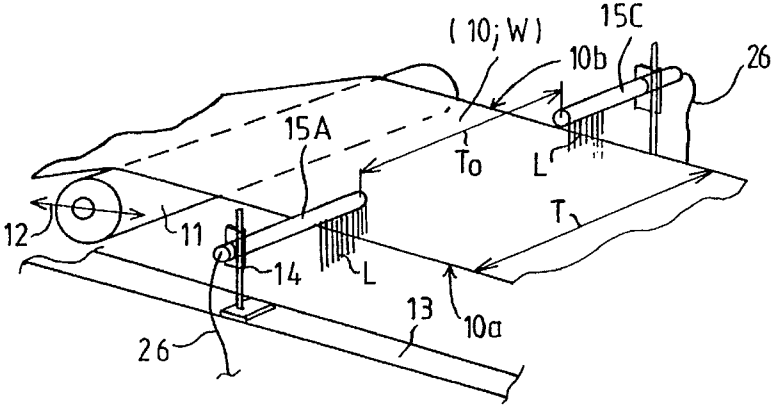
FIG. 7 shows an arrangement of measurement heads in accordance with the present invention in connection with opposite edges of the web to be monitored.

FIG. 7 shows measurement heads 15A and 15C in accordance with the present invention arranged at both edges 10*a* and 10*b* of the wire 10 or the web W, by means of which measurement heads the positions of the edges 10*a* and 10*b* are monitored. Heads 15A and 15C are placed substantially at the same transverse position. By jointly processing the signals of the measurement heads 15A and 15C, it is possible to monitor and to measure the transverse width T of the web W when the distance $T_0$ between the measurement heads is precisely known. In this manner, in the method of the present invention, it is possible to monitor, e.g., the drying shrinkage of the web W as it runs through the dryer section 73 and shrinks at the same time in the transverse direction during, and as a result of, the drying.

Figure 8:
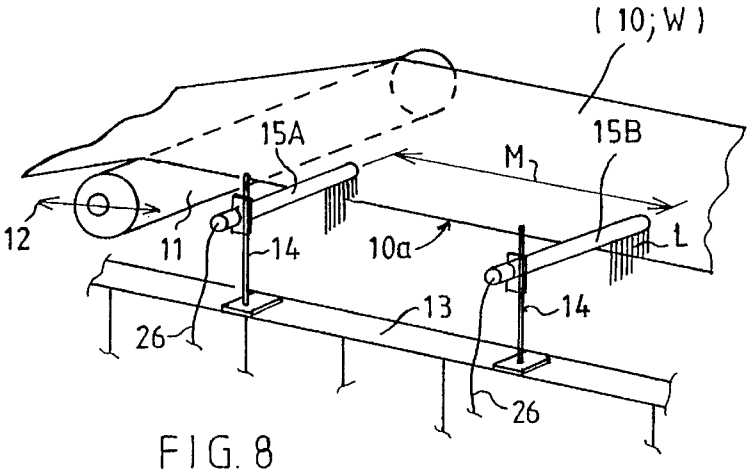
FIG. 8 shows, in a manner corresponding to FIG. 7, the joining or mating of two measurement heads in accordance with the present invention one after the other in connection with the same edge of the web to be monitored.

FIG. 8 shows two measurement heads 15A and 15B placed one after the other at a certain distance M from one another. The measurement heads 15A and 15B may operate "in parallel" so that they ensure the operation of each other so that in the event one of the measurement heads 15A, 15B becomes inoperative, and it can be removed for servicing without deterioration of the monitoring process. It is a further possibility of joint operation of the measurement heads 15A and 15B that, besides the location of the edge 10*a* of the wire 10 or web W, they are also used to measure the speed v of the wire 10 and/or the web W by determining the time to that the wire 10 and/or the web W takes when it runs the distance M ($v=M/t_0$) between the measurement heads 15A and 15B. The time $t_0$ can be determined by processing the electric signals obtained from the measurement heads 15A and 15B by means of the correlation technique.

The edge of a wire 10 or a web W is always to some extent "alive" (the edge 10*a* is not a straight line), which effect produces a corresponding high-frequency oscillation in the signals obtained from the measurement heads 15A and 15B, whereby the time $t_0$ can be determined by means of the correlation technique in a way in the other respects in itself known. The frequency range of the oscillations on whose basis the speed v is determined is considerably higher, at least by one order higher, than the frequency of change in the position of the web 10,W. Thus, the signals of change can be separated from each other, e.g., by means of filters. The principles of the correlation technique have been described with respect to the measurement of the flow velocity of the pulp suspension in a paper machine, for example, in Finnish Patent No. FI 67,627 (corresponding to U.S. Pat. No. 4,484,478, the specification of which is hereby incorporated by reference herein).

Figure 9:
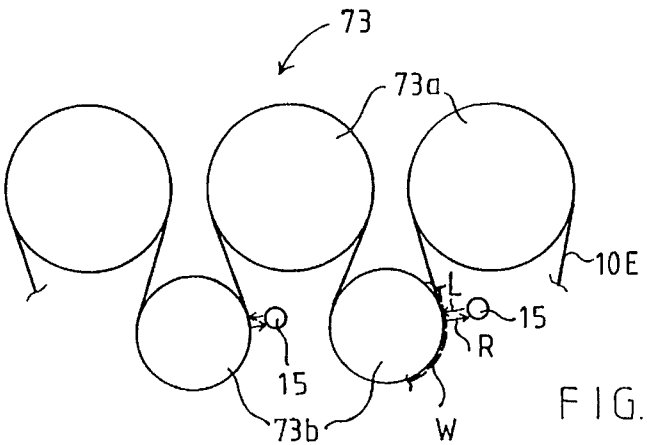
FIG. 9 shows an application of measurement heads in accordance with the present invention as a paper-web break detector in a group having a single-wire draw in the dryer section of a paper machine.

Referring to FIG. 9, measurement heads 15 in accordance with the present invention are placed in proximity to the paper web W running on the drying wire 10E. Measurement heads 15 operate as detectors of web W breaks in the dryer section 73 as the drying wire 10E runs over the drying cylinders 73*a* and the reversing suction rolls 73*b* so that the web W to be dried is pressed by the drying wire 10E into direct contact with the heated faces of the cylinders 73*a* and, on the reversing suction rolls 73*b*, at the side of the outside curve. In this situation, the presence of the web W and/or the location of its edge 10*a* is detected by the measurement head 15. In the same connection, it is also possible to detect the locations of both edges 10*a*, 10*b* of the web W and thereby, by means of the principle described in FIG. 7, the width T of the web W, for example, when it is desirable to monitor the drying shrinkage of the web W as it runs through the dryer section 73, and is dried at the same time.

Figure 10:
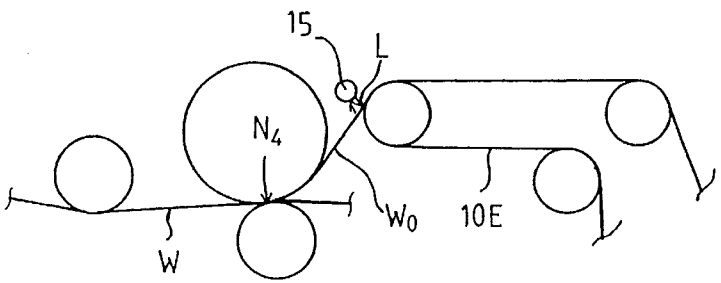
FIG. 10 shows an application of a measurement head in accordance with the present invention as a break detector in a press section.

FIG. 10 shows a measurement head 15 arranged after the last nip $N_4$ in the press section on the free draw $W_0$ of the web W as it is passed onto the drying wire 10E. Also in this connection, besides a web $W_0$ break, it is also possible to monitor the location of one or both of its edges 10*a*,10*b*, and thereby, if necessary, it is also possible to measure the width of the web W.

The examples provided above are not meant to be exclusive. Many other variations of the present invention would be obvious to those skilled in the art, and are contemplated to be within the scope of the appended claims.

We claim:

1. A method for monitoring a moving web, comprising the steps of:

arranging a series of transmitters to direct a bar of radiation beams at a face of the web in a direction substantially transverse to a direction of movement of the web, arranging a series of receivers to detect radiation reflected from the web and background, passing measurement signals corresponding to the detected radiation from said series of receivers to an electronic unit, determining a quantity in said electronic unit from the measurement signals that characterizes the monitoring of the web, determining digitally an approximate location of an edge or a corresponding discontinuity in the web on the basis of the largest change in reflected radiation detected by said series of receivers in an area of one of said series of transmitters, and determining analogously the precise location of the edge or corresponding continuity of the web by comparing values of the measurement signals of adjacent ones of said series of receivers situated closest to said one of said series of transmitters.

2. The method of claim 1, further comprising causing each of said series of transmitters to transmit a pulse alternatingly one after the other to form the radiation bar, and reading receiving pulses at said series of receivers synchronously with each transmitter pulse at a specified point of time, and repeating a sequence of transmitter pulses and receiving pulses at short time intervals by controlling said electronic unit.

3. The method of claim 2, further comprising arranging said electronic unit to control said series of transmitters by activating individual ones of said series of transmitters alternatingly in a specific sequence so that two adjacent ones of said series of transmitters are activated and one of said series of receivers situated between the adjacent transmitters reads a receiving pulse simultaneously.

4. The method of claim 1, further comprising arranging a first reference transmitter outside an area of measurement to direct a radiation beam outside the edge of the web, and arranging a second reference transmitter to direct a radiation beam entirely within the web.

5. The method of claim 1, further comprising arranging said series of receivers such that receiving sectors of adjacent ones of said series of receivers overlap each other.

6. The method of claim 1, further comprising arranging said series of transmitters and said series of receivers on first and second measurement heads, arranging said first and second measurement heads substantially in the same position at both edges of the web, and determining the transverse width of the web on the basis of the measurement signals.

7. The method of claim 1, further comprising arranging said series of transmitters and said series of receivers on first and second measurement heads, and arranging said first and second measurement heads at the same edge of the web at a distance from each other such that said first and second measurement heads operate "in parallel" and back-up the operation of one another.

8. The method of claim 7, further comprising determining the speed of the web on the basis of the measurement signals by calculating the running time of the web in relation to the distance between said first and second measurement heads by a correlation technique.

9. The method of claim 1, further comprising arranging said series of transmitters and said series of receivers on at least one measurement head, and utilizing the measurement signals to detect a break in, or the presence of, the paper or board web as the web runs on support of a fabric, a drying wire and/or as a free draw.

10. The method of claim 1, further comprising arranging said series of transmitters and said series of receivers on at least one measurement head, and utilizing the measurement signals as regulation signals in a feedback-connected regulation system which regulates control means that control the transverse position of the web.

11. The method of claim 1 as applied in a paper machine, further comprising arranging said series of transmitters and said series of receivers on at least one measurement head, and connecting said electronic unit through a series cable and/or by corresponding I/O control wires to a process or automation system of the paper machine, and controlling a sequence of measurement through said series of transmitters and said series of receivers by a control logic unit arranged in said electronic unit.

12. The method of claim 1, wherein the web is a wire in a paper machine, a felt, a material web, a board or paper web.

13. A device for monitoring an edge of a moving web or a point of discontinuity in the web, comprising a measurement head, a series of radiation transmitters arranged in said measurement head and directing a bar of radiation beams at a face of the web in a direction substantially transverse to a direction of movement of the web, a series of radiation receivers arranged in said measurement head, said receivers structured and arranged to receive radiation derived from said radiation transmitters and reflected from the web to be monitored and background environment, said receivers being arranged in a row to alternate with said transmitters such that each of said receivers is arranged between, and detects radiation derived from, a pair of said transmitters, said row of receivers and transmitters being oriented in a direction substantially transverse to a running direction of the web, and an electronic unit in which a web monitoring quantity is formed by the application of an analog-digital principle of measurement, said electronic unit comprising a control logic which controls a measurement sequence of said transmitters and said receivers, and a signal-transfer unit arranged to transfer measurement signals derived from said receivers successively to said electronic unit, said electronic unit further comprising means for determining digitally an approximate location of an edge or a corresponding discontinuity in the web on the basis of the largest change in reflected radiation detected by said receivers in an area of one of said transmitters and means for determining analogously the precise location of the edge or corresponding continuity of the web by comparing values of the measurement signals of adjacent ones of said receivers situated closest to said one of said transmitters.

14. The device of claim 13, wherein said measurement head comprises a box having an interior and an elongate opening for transmission and receiving of the radiation, said transmitters and receivers being arranged in the interior of said box.

15. The device of claim 13, wherein said transmitters comprise light emitting diodes (LEDs) and said receivers comprise photodiodes, said transmitters and receivers being uniformly spaced and arranged such that one of said transmitters is arranged on both sides of each of said receivers.

16. The device of claim 13, further comprising a first reference transmitter arranged outside an area of measurement to direct a radiation beam outside the edge of the web and a second reference transmitter arranged to direct a radiation beam entirely at a face of the web.

17. The device of claim 13, wherein said measurement head is arranged in a box having an inner casing, an outer casing and thermal insulations between said inner casing and said outer casing, said box being connected to circulation means for circulating cooling and/or cleaning air.

18. The device of claim 13, wherein said series of transmitters comprises between 4 and 15 transmitters, said transmitters and said receivers being arranged in a straight line at a distance from about 15 mm to about 30 mm from each other, a perpendicular distance between said measurement head and a plane of the web being in a range from about 150 mm to about 250 mm, the width of an area of measurement via said measurement head being in a range from about 100 mm to about 200 mm, the duration of pulses of radiation from said transmitters being in a range from about 10 μs to about 100 μs.

19. The device of claim 18, wherein said series of transmitters comprises between 5 and 8 transmitters, said transmitters and said receivers being arranged in a straight line at a distance of about 20 mm from each other, the duration of pulses of radiation from said transmitters being about 50 μs.

20. A method for determining a transverse width of a moving web, comprising the steps of:

arranging a series of transmitters to direct a bar of radiation beams at a face of the web in a direction substantially transverse to a direction of movement of the web, arranging a series of receivers to detect radiation reflected from the web and background, arranging said series of transmitters and said series of receivers on first and second measurement heads, arranging said first and second measurement heads substantially in the same position at both edges of the web, passing measurement signals corresponding to the detected radiation from said series of receivers to an electronic unit, determining digitally an approximate location of edges of the web on the basis of the largest change in reflected radiation detected by said series of receivers in an area of one of said series of transmitters, determining analogously the precise location of the edges of the web by comparing values of the measurement signals of adjacent ones of said series of receivers situated closest to said one of said series of transmitters, and determining the transverse width of the web on the basis of the location of the edges of the web.

* * * * *